US006051938A

United States Patent [19]

Arts et al.

[11] Patent Number: 6,051,938

[45] Date of Patent: Apr. 18, 2000

[54] DIMMABLE BALLAST WITH ACTIVE POWER FEEDBACK CONTROL

[75] Inventors: Paulus P. B. Arts; Everaard M. J. Aendekerk, both of Eindhoven, Netherlands

[73] Assignee: U.S. Philips Corporation, New York, N.Y.

[21] Appl. No.: 09/110,614

[22] Filed: Jul. 6, 1998

[30] Foreign Application Priority Data

Jul. 10, 1997 [EP] European Pat. Off. ..... 97202122

[51] Int. Cl.[7] ..... H05B 37/02

[52] U.S. Cl. ..... 315/291; 315/200 R; 315/207; 315/307

[58] Field of Search ..... 315/291, 209 R, 315/244, 307, DIG. 5, 224, 200 R, 204, 205, 207

[56] References Cited

U.S. PATENT DOCUMENTS 5,525,872 6/1996 Achten et al. ..... 315/291

FOREIGN PATENT DOCUMENTS

9610897A1 4/1996 WIPO .

*Primary Examiner*—David H. Vu

*Attorney, Agent, or Firm*—Bernard Franzblau

[57] ABSTRACT

A circuit arrangement for high-frequency operation of a discharge lamp comprises a low-frequency rectifier for generating a DC voltage (buffer voltage) across a first capacitor (C1) from a low-frequency supply voltage. A DC/AC converter generates a high-frequency AC voltage from the buffer voltage. A load branch is coupled to the DC/AC converter and is provided with coupling terminals for coupling the discharge lamp to the load branch. A high-frequency rectifier (HR) converts the high-frequency voltage generated by the DC/AC converter into a DC voltage and comprises a series arrangement of first and second diodes (D5, D6) which have the same orientation. A control circuit (CR) controls the power consumed by the discharge lamp to a level which is dependent on a control signal (Sg). The high-frequency rectifier further comprises a switching device and a further control circuit (CR1). The switching device shunts at least one of the diodes of a feedback unit. The further control circuit controls the switching device dependent on the control signal.

17 Claims, 4 Drawing Sheets

DIMMABLE BALLAST WITH ACTIVE POWER FEEDBACK CONTROL

BACKGROUND OF THE INVENTION

This invention relates to a circuit arrangement for high-frequency operation of a discharge lamp, comprising:

- input terminals for connection to a low-frequency supply voltage source,
- low-frequency rectifying means for generating a DC voltage across first capacitive means from a low-frequency supply voltage delivered by the low-frequency supply voltage source,
- a DC/AC converter for generating a high-frequency AC voltage from the DC voltage,
- a load branch comprising a series arrangement of inductive means, second capacitive means, and coupling means for coupling the discharge lamp to the load branch, which load branch is coupled to the DC/AC converter,
- high-frequency rectifying means for converting a high-frequency voltage generated by the DC/AC converter into a DC voltage, which high-frequency rectifying means are coupled to the first capacitive means and to the load branch and comprise a series arrangement of first and second unidirectional means having the same orientation, and
- control means for controlling the power consumed by the discharge lamp to a level which is dependent on a control signal which is a measure for a desired power.

Such a circuit arrangement is known from WO 96/10897. The first rectifying means in the known circuit arrangement are constructed as a voltage doubler, and the first capacitive means across which the voltage doubler generates a DC voltage comprise a first and a second capacitive impedance. The voltage across the first capacitive means is also referred to as buffer voltage hereinafter. The load branch comprises besides the inductive means, the second capacitive means, and the coupling means, also further capacitive means. One side of the further capacitive means is connected to a junction point. A further side of the further capacitive means is connected to another junction point. The power consumed by the discharge lamp, also referred to as lamp hereinafter, can be controlled by control means which influence the duty cycle of the switching elements.

The first rectifying means are provided with first and second unidirectional means which also form part of the second rectifying means. The second rectifying means are to ensure that the circuit arrangement behaves substantially as a resistive impedance during lamp operation. The circuit arrangement will cause comparatively little radio interference in that case and will have a high power factor during lamp operation. This means that the buffer voltage must always be higher than a bottom value. When the voltage doubler is used, the bottom value is equal to the peak-to-peak voltage of the low-frequency voltage source. The bottom value is equal to the peak voltage if no voltage doubling takes place. The buffer voltage rises comparatively strongly in proportion as the adjusted power is lower in the known circuit arrangement. On the one hand this requires a dimensioning of the circuit arrangement such that the buffer voltage is higher than the bottom value during nominal operation. On the other hand, components such as the switching elements and the first capacitive means must be designed for high voltages, or the range over which the lamp power is controllable must be limited so as to avoid damage to said components.

SUMMARY OF THE INVENTION

It is an object of the invention to provide a circuit arrangement of the kind described in the opening paragraph in which the variation of the buffer voltage across the first capacitive means remains limited over a comparatively wide range of powers consumed by the discharge lamp, while said buffer voltage is higher than the bottom value over said range.

According to the invention, the circuit arrangement is for this purpose characterized in that the high-frequency rectifying means in addition comprises further control means and a parallel branch provided with switching means, which parallel branch shunts at least one of the unidirectional means of the high-frequency rectifying means, while said further control means controls the switching means in a manner which is dependent on the control signal.

In dependence on the value of the control signal, the operation of the high-frequency rectifying means is counteracted to a greater or lesser extent by the parallel branch, so that the variation in the buffer voltage is limited.

The discharge lamp and the circuit arrangement may be indetachably coupled. In that case, the coupling means may be constructed as a fixed electrical connection between the load branch and the lamp. Alternatively, a transformer may be included in the load branch for effecting an electrical separation between the load branch and the lamp. In another embodiment, the lamp is detachably coupled to the circuit arrangement. The coupling means may be constructed as contact sockets which are to cooperate with contact pins of the lamp in that case.

The operation of the further control means may be directly dependent on the control signal. Alternatively, the operation may be indirectly dependent on the control signal, for example dependent on a further signal such as a signal which is a measure of the power actually consumed by the lamp, which is a function of the control signal. It is favorable when the operation of the further control means is directly dependent on the buffer voltage. A strong reduction in the variation of the buffer voltage is possible then.

In an attractive embodiment, the further control means triggers the switching means periodically alternately into a conducting and a non-conducting state during operation with a duty cycle which is dependent on the control signal. It is possible in this embodiment to realize a strong limitation of the variation in the buffer voltage with only a single switching element.

It is favorable when the switching of the switching means into the conducting state takes place while the unidirectional means shunted by the parallel branch are in a conducting state. Switching into the conducting state may then take place while there is no voltage across the switching means. This reduces switching losses and has a favorable influence on the life of the switching means. A yet further reduction in the switching losses and a further improvement of the useful life can be realized in an embodiment in which the action of switching the switching means into the non-conducting state again also takes place while said unidirectional means are in a conducting state. Switching into the non-conducting state while said unidirectional means are non-conducting, however, is preferable. A stepless dependence can then be realized between the value of the control signal and the degree to which the operation of the high-frequency rectifying means is eliminated.

A further attractive embodiment of the circuit arrangement according to the invention is characterized in that the high-frequency rectifying means comprises two or more feedback elements which are each provided with first and second unidirectional means, wherein at least one of the unidirectional means of each of the feedback units is shunted by a parallel branch provided with switching means, while the further control means bring each of the switching means into a stable state which is dependent on the control signal. Electromagnetic interference is avoided here in a simple manner in that the switching means needs only be switched when the power of the lamp is controlled to a different level. The circuit arrangement may have more or fewer feedback units in dependence on the desired limitation in the buffer voltage variation for a given range of powers to be controlled. It was found that two high-frequency feedback units are usually sufficient. It is favorable when the feedback branches of the feedback units have mutually different impedance values.

A favorable modification of this embodiment is one which is characterized by control signal generation means for generating a control signal which is adjustable in steps, said control signal generation means being coupled to the further control means, while each setting of the control signal corresponds to a respective combination of states of the switching means. It is possible by means of the control signal generation means to adjust the power consumed by the lamp to a number, for example three, of different levels. Since the control signal generation means is coupled to the further control means, and each setting of the control signal corresponds to a respective combination of states of the switching means, an optimized value of the buffer voltage can be realized for each possible setting of the control signal.

An advantageous embodiment of the circuit arrangement according to the invention is characterized in that the high-frequency rectifying means is connected to a junction point N3 in the load branch via a first feedback branch and to a junction point N5 in the load branch via a further feedback branch, and in that the coupling means are connected between the junction point N3 and the junction point N5 in the load branch. The load of the high-frequency rectifying means is distributed over a number of components in this embodiment of the circuit arrangement according to the invention. These components may accordingly have a comparatively low loading capacity and may thus be inexpensive.

The control means may control the power consumed by the discharge lamp, for example, by influencing the frequency of the DC/AC converter. This frequency is adjusted, for example, to a constant value for each desired lamp power. In another embodiment, the control means modulates the frequency of the DC/AC converter periodically between a high frequency and a low frequency. The power consumed by the lamp then rises approximately linearly with the relative duration of the intervals of low frequency. Alternatively, for example, the control means described in U.S. Pat. No. 5,525,872 may be used. The control means described therein influences the period Tt-Td of the switching elements. Tt here is the time interval during which the switching element is conducting, and Td the time interval during which a freewheel diode shunting the switching element is conducting. In yet another embodiment, the control means adjusts the power consumed by the lamp by means of the duty cycle of the switching elements in the first branch, in which case the frequency of the DC/AC converter can remain constant.

BRIEF DESCRIPTION OF THE DRAWING

These and other aspects of the circuit arrangement according to the invention will be explained in more detail with reference to a drawing, in which.

DESCRIPTION OF THE PREFERRED EMBODIMENTS

Figure 1:
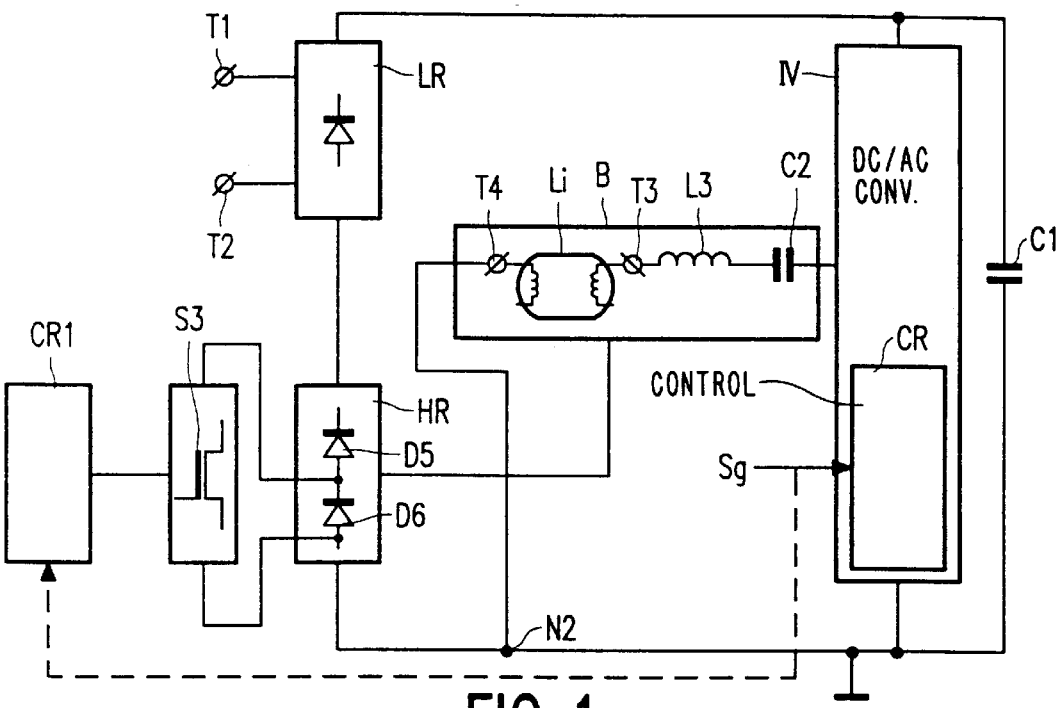
FIG. 1 diagrammatically shows a first embodiment.

FIG. 1 diagrammatically shows a first embodiment of the circuit arrangement according to the invention for the high-frequency operation of a discharge lamp. The circuit arrangement shown comprises input terminals T1, T2 for connection to a low-frequency supply voltage source Vin. The circuit arrangement further comprises low-frequency rectifying means LR for generating a DC voltage across first capacitive means C1 from a low-frequency supply voltage delivered by the low-frequency supply voltage source. The circuit arrangement further comprises a DC/AC converter IV for generating a high-frequency AC voltage from the DC voltage. A load branch B comprises a series arrangement of inductive means L3, second capacitive means C2, and coupling means T3, T4 for coupling the discharge lamp Li to the load branch. The load branch is coupled to the DC/AC converter. The circuit arrangement is further equipped with high-frequency rectifying means HR for converting a high-frequency voltage generated by the DC/AC converter into a DC voltage. The high-frequency rectifying means are coupled to the first capacitive means C1 and to the load branch B. The high-frequency rectifying means HR comprises a series arrangement of first and second unidirectional means D5, D6 which have the same orientation. The circuit arrangement is further provided with control means CR for controlling the power consumed by the discharge lamp Li to a level which is dependent on a control signal Sg which is a measure for a desired power.

The circuit arrangement has the characteristic that the high-frequency rectifying means in addition comprise further control means CR1 and a parallel branch provided with switching means S3. The parallel branch shunts at least one of the unidirectional means D6 of the high-frequency rectifying means. The further control means control the switching means in a manner which is dependent on the control signal Sg.

Figure 2:
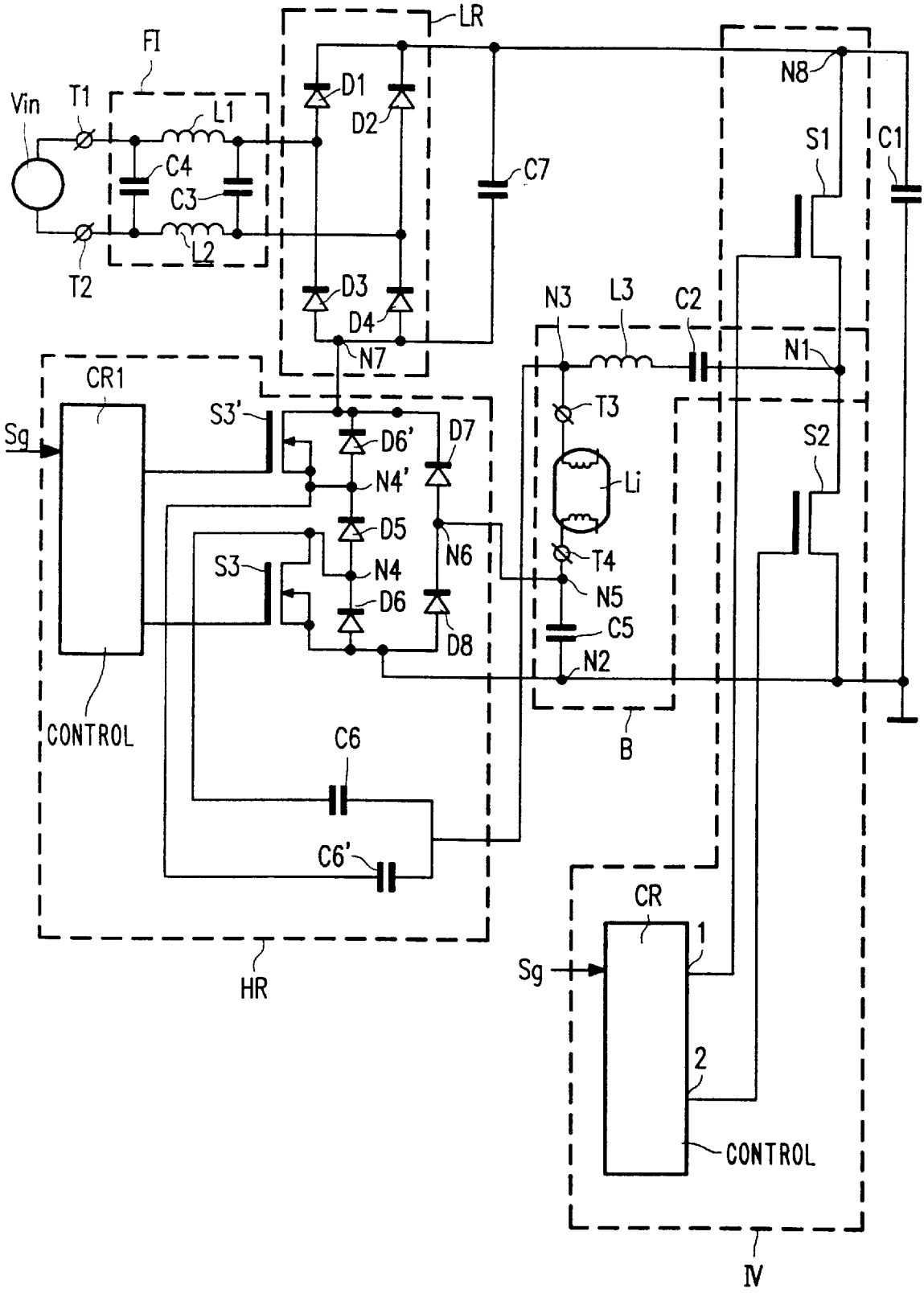
FIG. 2 shows the embodiment of FIG. 1 in more detail.

The circuit arrangement of FIG. 1 is shown in more detail in FIG. 2. The low-frequency rectifying means is coupled to the input terminals T1, T2 via an input filter FI provided with inductive impedances L1, L2 and capacitive impedances C3, C4. The input terminals T1, T2 are shunted by the capacitive impedance C4. A first side of the capacitive impedance C3 is connected to a first side of the capacitive impedance C4 via the inductive impedance L1. A second side of the capacitive impedance C3 is connected to a second side of the capacitive impedance C4 via the inductive impedance L2. Each of the sides of the capacitive impedance C3 is connected to the low-frequency rectifying means. The low-frequency rectifying means are shunted by a capacitive impedance C7.

The DC/AC converter IV comprises a first branch with a first and a second switching element S1, S2 which are in turn switched into a conducting state with a high frequency by control means CR during operation. Control electrodes of the switching elements are for this purpose connected to outputs 1, 2 of the control means CR.

The series arrangement in the load branch comprises in that order the second capacitive means formed by capacitive impedance C2, the inductive means formed by an inductive impedance L3, the coupling T4 constructed as lamp connection terminals T3, T4, and a further capacitive impedance C5. A current supply conductor of a respective electrode of the lamp Li is connected to each of the lamp connection terminals T3, T4. The electrodes have additional current supply conductors which are not connected. The coupling means in an alternative embodiment comprises additional lamp connection terminals T3', T4' (not shown) for the purpose of preheating or additional heating. A further current supply conductor of a respective electrode is connected to each of these additional connection terminals. The additional lamp connection terminals may be interconnected by a capacitive impedance. In a modification, the lamp connection terminals T3 and T4' are interconnected by a series arrangement of a capacitive impedance and a winding which is magnetically coupled to inductive impedance L3. The lamp connection terminals T4 and T4' are interconnected in a similar manner in that case. In the embodiment shown, a first end of the load branch is formed by one side of capacitive impedance C2. This is connected to a junction point N1 in the first branch between the first and the second switching element. A second end of the load branch, formed by a side of capacitive impedance C5, is connected to a junction point N2 between the low-frequency rectifying means LR and the first capacitive means C1.

The high-frequency rectifying means HR is coupled here to the first capacitive means C1 in that they form a series circuit with the low-frequency rectifying means LR, which series circuit shunts the first capacitive means. The high-frequency rectifying means HR comprises a first and a second feedback unit. The first feedback unit is provided with a first series arrangement of first and second unidirectional means having the same orientation and formed by the consecutive unidirectional elements D6 and D5. The unidirectional element D5 at the same time forms part of a second series arrangement of unidirectional means, also having the same orientation, of a second feedback unit. Unidirectional elements D5 and D6' therein form the respective first and second unidirectional means. The first feedback unit in addition comprises a first feedback branch provided with a capacitive impedance C6. The first feedback branch connects a junction point N3 in the load branch to a junction point N4 present between the first and the second unidirectional means D5, D6. A second feedback branch provided with a capacitive impedance C6' connects the junction point N3 to a further junction point N4' between the first and the second unidirectional means D5, D6' of the second feedback unit. The capacitive value of the capacitive impedance C6' is lower than that of the capacitive impedance C6.

One of the unidirectional means, D6, D6', of both the first and the second feedback unit is shunted by a parallel branch. A first parallel branch provided with switching means S3 shunts the second unidirectional means D6 of the first feedback unit. A second parallel branch provided with switching means S3' shunts the second unidirectional means D6' of the second feedback unit. The further controls means CR1 control the switching means S3, S3' each in a manner which is dependent on the control signal Sg. Depending on the value of the control signal, the further control means will bring the switching elements S3, S3' into a stable state, which is either conducting or non-conducting.

In the circuit arrangement shown, the high-frequency rectifying means HR comprise a further feedback unit. The further feedback unit is provided with a further series arrangement of first and second unidirectional means having the same orientation and formed consecutively by the unidirectional elements D7 and D8. The further feedback unit is in addition provided with a further feedback branch which connects a junction point N5 in the load branch to a junction point N6 between the first and the second unidirectional means of the further series arrangement. The coupling means T3, T4 are connected between the junction point N3 and the junction point N5 in the load branch. The first series arrangement shunts the series arrangement of unidirectional elements D5, D6, and D6'.

Figure 3:
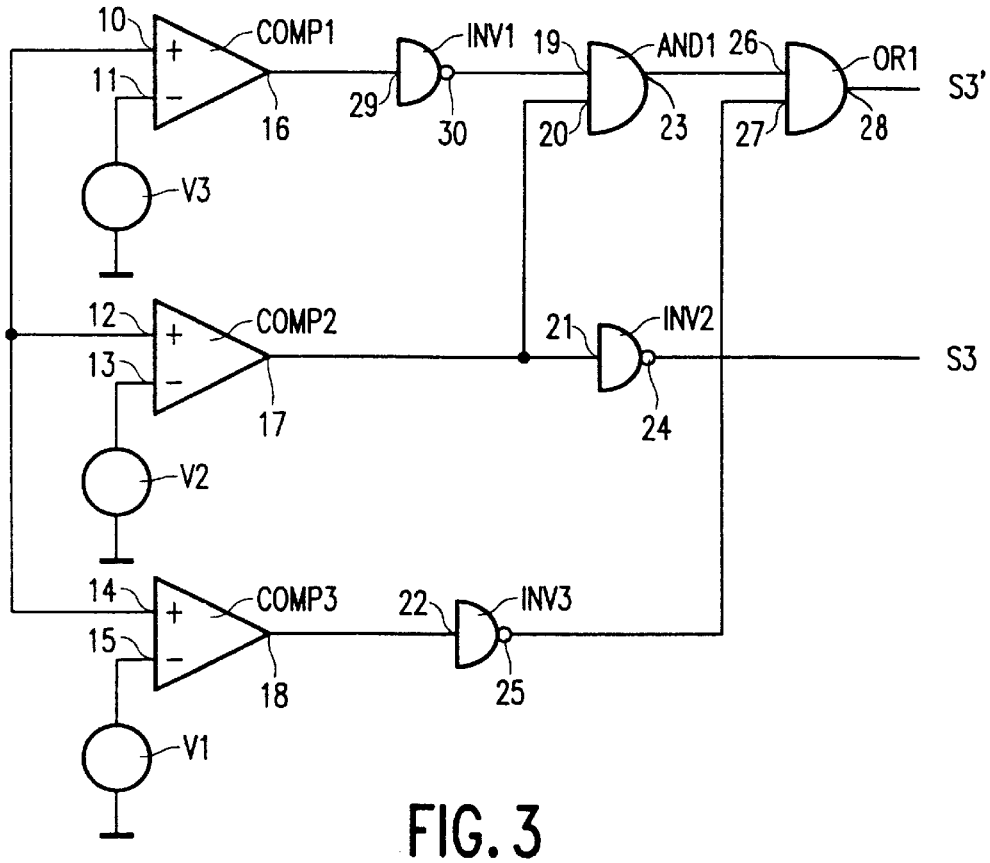
FIG. 3 shows the further control means of the embodiment of FIG. 1 in more detail.

The further control means for controlling the auxiliary switching elements S3 and S3' are shown in more detail in FIG. 3. Non-inverting inputs 10, 12, and 14 of comparators COMP1, COMP2, and COMP3 receive the control signal Sg which is a measure for the desired lamp power. Inverting inputs 11, 13, and 15 of the comparators COMP1, COMP2, and COMP3 are connected to DC voltage sources which supply reference voltages V3, V2, and V1, respectively. Output 16 of comparator COMP1 is connected to input 29 of inverter INV1. An output 30 of said inverter is connected to a first input 19 of an AND gate AND1. A second input 20 of this AND gate is connected to output 17 of comparator COMP2. Output 23 of AND gate AND1 is connected to a first input 26 of OR gate OR1. A second input 27 of OR gate OR1 is connected to output 25 of inverter INV3. Input 22 of this inverter is connected to output 18 of comparator COMP3. The output 28 of OR gate OR1 controls the switching element S3'. Switching element S3 is controlled by output 24 of inverter INV2. Input 21 thereof is connected to output 17 of comparator COMP2.

The circuit arrangement according to the invention as shown in FIGS. 1, 2, and 3 operates as follows. When a low-frequency voltage source is connected to the input terminals T1, T2, for example a mains voltage of 220 V and 50 Hz, the first capacitive means C1 is charged via the input filter FI, the low-frequency rectifying means LR, and the high-frequency rectifying means. The control means CR periodically opens and closes the switching elements S1, S2 such that a high-frequency, substantially square-wave voltage is generated at the junction point N1. This voltage causes an alternating current to flow through the second capacitive means C2 and the inductive means L3. A first portion of this current flows through the lamp connection terminals T3, T4, and the lamp Li connected thereto, and capacitive impedance C5 to junction point N2. When the switching elements S3, S3' are conducting, a second portion of the current flows partly through capacitive impedance C6 to junction point N4 and partly through capacitive impedance C6' to junction point N4'. A remaining portion flows through the conductive connection from junction point N5 to junction point N6. As a result of this, a high-frequency voltage is present both at junction points N4, N4' and at junction point N5 with the same frequency as the substantially square-wave AC voltage at the junction point N1. These voltages at the junction points N4, N4', and N6 cause a current to flow from the supply voltage source Vin also if the buffer voltage is higher than the instantaneous value of the rectified voltage of said source. The power factor of the circuit arrangement is comparatively high as a result, and the total harmonic distortion comparatively low.

Depending on the value of the control signal Sg, the switching elements S3 and S3' are controlled into a conducting (1) or a non-conducting (0) state in accordance with the following Table:

| Sg(V) | S3 | S3' |
|---|---|---|
| >V3 | 0 | 0 |
| V2 – V3 | 0 | 1 |
| V1 – V2 | 1 | 0 |
| <V1 | 1 | 1 |

Both switching elements S3 and S3' are non-conducting for a control signal value higher than V3. Accordingly, the first, the second, and the further feedback branch all contribute to the charging of the first capacitive means C1. If the desired lamp power is set for a value such that the control signal value Sg lies between V2 and V3, the switching element S3' is switched into a conducting state, so that the current through the second feedback branch no longer contributes to the charging of the first capacitive means C1. The increase in the buffer voltage is limited thereby. If the desired lamp power is set for a yet lower value such that the value of the control signal Sg lies between V1 and V2, the switching element S3' is made non-conducting again, and the switching element S3 is brought into a conducting state. Since the capacitive value of capacitive impedance C6' is lower than that of capacitive impedance C6, the current with which the first capacitive means C1 are charged is further reduced. If the control signal Sg has a value lower than V1, it is only the further feedback branch N5-N6 which contributes to the charging of the first capacitive means. The contribution of this current may be so chosen by means of the capacitive means C5 that this current does not lead to an excessively high buffer voltage also for a low lamp power. The switching means S3, S3' controlled by the further control means CR1 thus limit the variation in buffer voltage over a wide range of adjusted powers.

In a practical realization of the above embodiment, the capacitive impedances C1, C2, C3, C4, C5, C6, C6', and C7 have respective capacitance values of 10 $\mu$F, 180 nF, 220 NF, 100 nF, 18 nF, 2.7 nF, 5.6 nF, and 180 nF. The inductive impedances L1 and L2 each has an inductance value of 22 mH and together form a common mode transformer. The inductive impedance L3 has an inductance value of 930 $\mu$H. FETs of the 830 type, make International Rectifier, serve as the switching elements S1 and S2. FETs of the 1N50 type, make Samsung, form the switching elements S3 and S3'. The unidirectional elements D1 to D4 are constructed as type IN4007 diodes, make Philips. Diodes of the BYD37J type, also make Philips, are used as the unidirectional elements D5, D6, D6', D7, and D8. The control means CR are constructed as an integrated circuit of the SG 3524 N type, make SGS-Thomson.

Figure 4:
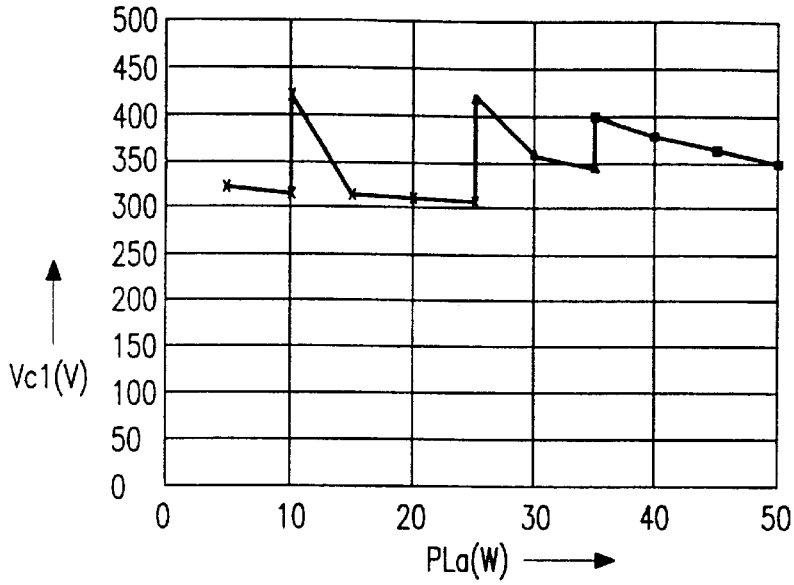
FIG. 4 shows the buffer voltage Vc1 as a function of the power Pla consumed by the lamp.

In the embodiment, the power consumed by the lamp is approximately proportional to the control signal Sg. The lamp consumes a rated power of 50 W for a value of the control signal Sg equal to 10 V. The reference voltages V1, V2, V3 are 2, 5, and 7 V, respectively. The circuit arrangement shown was connected to a voltage source supplying a mains voltage of 220 V at a frequency of 50 Hz. The lamp power was controlled between 10 and 50 W by means of the frequency of the DC/AC converter. The duty cycle of the switching elements S1, S2 was maintained at 50%. As FIG. 4 shows, variations in the buffer voltage are limited, and the buffer voltage is higher than the bottom value, here the peak value of the low-frequency supply source, i.e. 311 V. The buffer voltage in this case varied between 330 and 425 V.

A modified version of this embodiment of the circuit arrangement according to the invention in addition comprises control signal generation means for generating a control signal which is adjustable in steps. The control signal generation means is coupled to the further control means. Each setting of the control signal corresponds to a respective combination of states of the switching means. In a practical embodiment of this modified version, the control signal generation means generates a control signal which is adjustable to the values 3, 6, and 10 V. The powers consumed by the lamp are 14, 30, and 50 W, respectively, at these settings of the control signal. The settings correspond to the respective combinations of states (1,0), (0,1), and (0,0), in which the first and the second number indicate the respective states of the switching means S3 and S3', the number 0 denoting a non-conducting, the number 1 a conducting state. The buffer voltage has a value of approximately 350 V at each of the above settings of the control signal.

Figure 5:
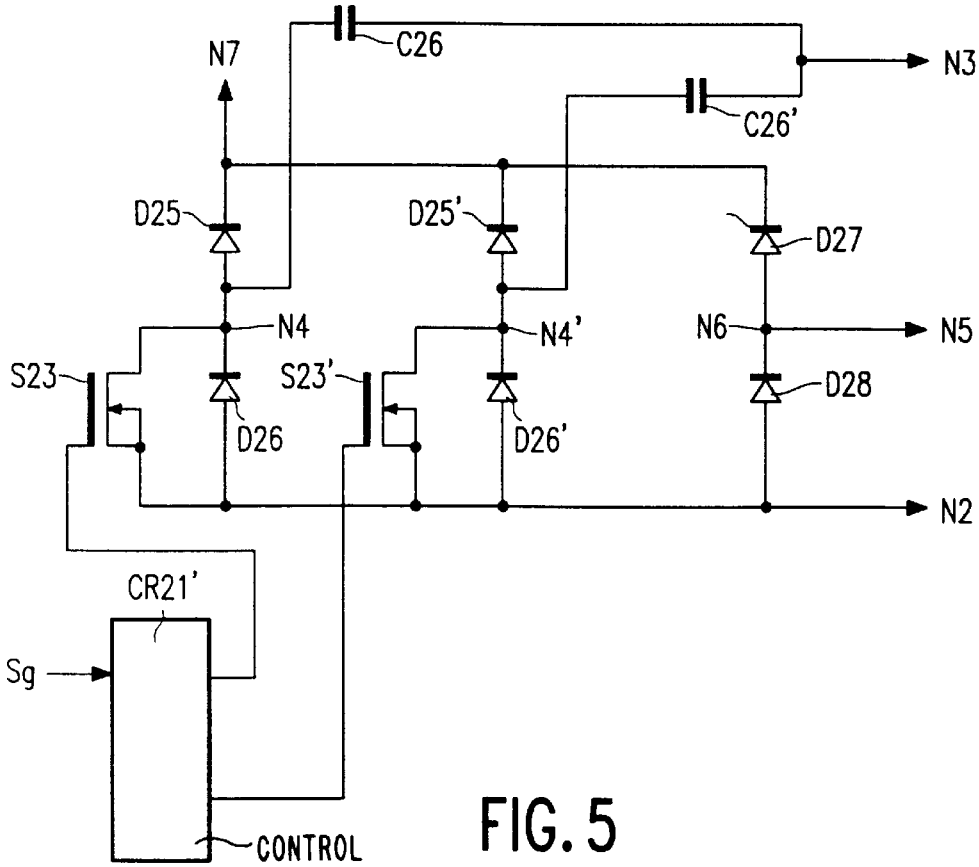
FIG. 5 shows the high-frequency rectifying means of a second embodiment.

FIG. 5 shows the high-frequency rectifying means in a second embodiment of the circuit arrangement according to the invention. Components therein corresponding to these of FIGS. 1 and 2 have reference numerals which are 20 higher. In the embodiment shown in FIG. 5, the high-frequency rectifying means again comprises a first, a second, and a further feedback unit. The first feedback unit comprises a first series arrangement of first and second unidirectional means formed by unidirectional elements D25, D26. The second feedback unit comprises a second series arrangement of first and second unidirectional means formed by unidirectional elements D25', D26'. Unidirectional elements D27 and D28 form a further series arrangement of first and second unidirectional means which forms part of the further feedback unit. Said three series arrangements D25, D26; D25', D26'; and D27, D28 are connected in parallel to one another here.

Figure 6:
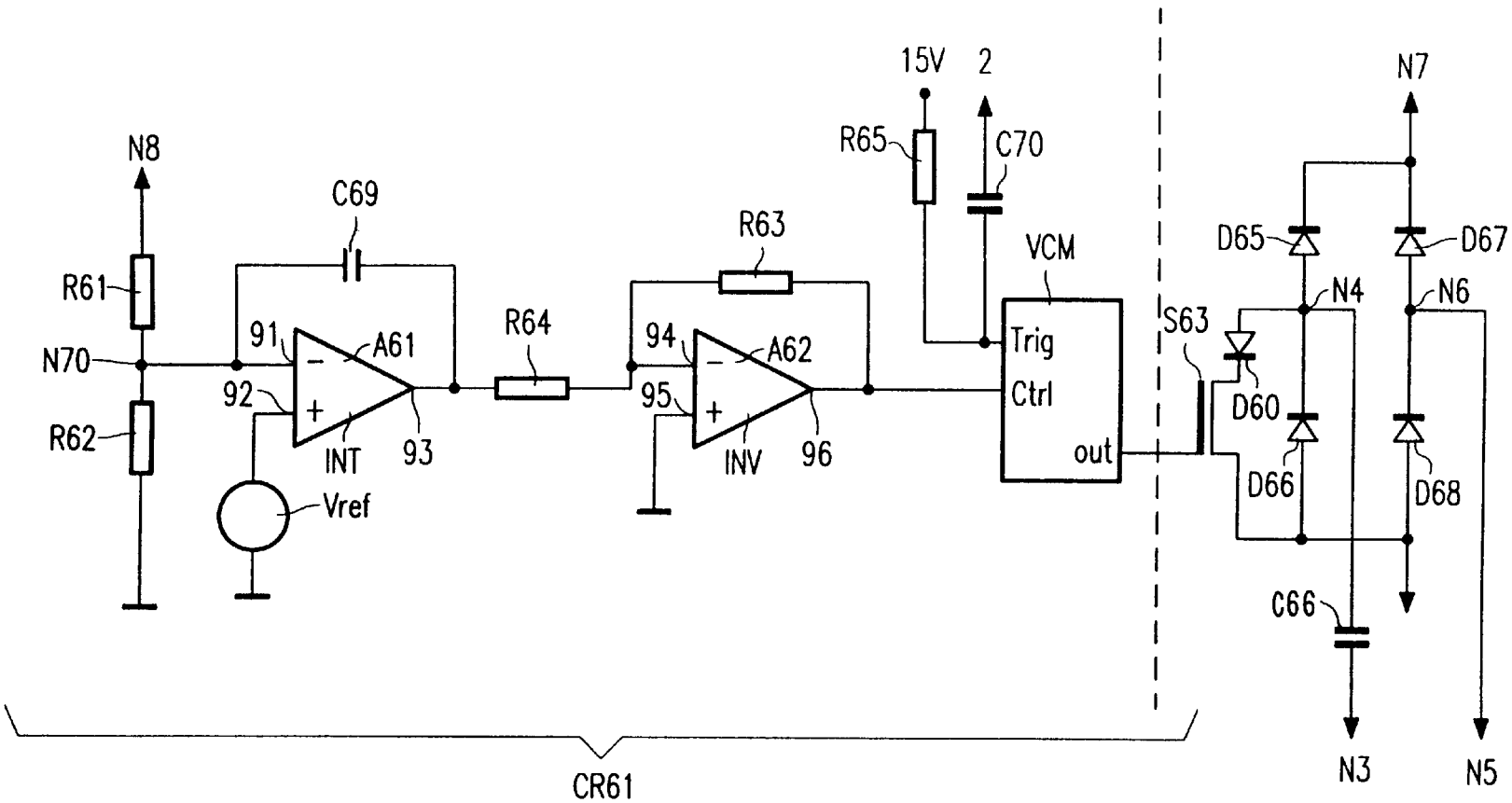
FIG. 6 shows the high-frequency rectifying means of a third embodiment.

FIG. 6 shows high-frequency rectifying means of a third embodiment of the circuit arrangement according to the invention. Components corresponding to those of FIGS. 1 and 2 have reference numerals which are 60 higher in FIG. 6. The parallel branch comprises a series arrangement of switching element S63 forming switching means and a unidirectional element D60. The further control means CR61 shown in FIG. 6 switches the switching means S63 periodically alternately into a conducting and a non-conducting state with a duty cycle which is dependent on the control signal Sg. In proportion as the duty cycle, i.e. the time fraction in which the switching element S63 is conducting, is greater, a larger portion of the current will flow away through the feedback branch N3-N4 via the switching element S63. The value of the duty cycle is dependent on the level of the buffer voltage, which in its turn is dependent on the control signal Sg which is a measure for the desired power of the lamp Li. The high-frequency rectifying means shown here may be used in the circuit arrangement of FIGS. 1 and 2, the reference symbols 2, N2, N3, N5, N7, and N8 denoting the connections between the high-frequency rectifying means and the other components of the circuit arrangement.

The further control means CR61 is provided with a voltage divider R61, R62, an integrator INT, an inverter INV, and a voltage-controlled monostable multivibrator VCM. The voltage divider comprises resistive impedances R61, R62. The integrator INT prevents low-frequency variations in the buffer voltage from causing instabilities in the control of the switching means S63. The integrator INT comprises an amplifier A61 and a capacitive impedance C69. Input 91 of the amplifier is connected to a common junction point N70 of the resistive impedances R61, R62. Output 93 of the amplifier A61 is further connected to the inverting input 91 via the capacitive impedance C69. A further, non-inverting input 92 of the amplifier A61 is connected to a reference voltage source Vref which supplies a voltage of 2.5 V. The inverter INV is formed by an amplifier A62 and a resistive impedance R63. An inverting input 94 of the amplifier A62 is connected to output 93 of amplifier A61 via a resistive impedance R64. Input 94 is further connected to output 96 of amplifier A62 via resistive impedance R63. A further, non-inverting input 95 is connected to ground. An input Ctr1 of the voltage-controlled monostable multivibrator VCM is connected to output 96 of amplifier A62. A further input Trig of this multivibrator is connected via a capacitive impedance C70 to the second output 2 of the control means CR, which controls the second switching element S2. A resistive impedance R65 furthermore connects the input Trig to a conductor having a constant DC voltage of 15 V. This coupling between the further control means CR61 and the control means CR achieves that switching into the conducting state of the switching means S63 takes place while the unidirectional means D66, shunted by the parallel branch with the switching means S63, is in a conducting state. Switching of the switching means S63 back to the non-conducting state takes place while the unidirectional means D66 is in a non-conducting state.

The high-frequency rectifying means shown in FIG. 6 operates as follows. During each period in which the second switching element S2 is switched into a conducting state by the control means CR, the switching element S63 is also switched into a conducting state during a time interval which is dependent on the instantaneous value of the buffer voltage. During that time interval, the current flows from the feedback branch from N3 to N4 via the switching element S63 to ground. After the time interval has elapsed, the current from the feedback branch from N3 to N4 contributes to the charging of the first capacitive means C1 until the second switching element S2 is again switched from the non-conducting into the conducting state. When the power of the lamp Li is set for a lower value, and the buffer voltage starts to rise as a result, the length of the time interval will also increase, so that the current from the feedback branch will flow away to ground during a greater portion of the time. The buffer voltage as a result rises considerably less than would be the case without the parallel branch with the controlled switching means S63. The result of this is that the buffer voltage changes only little over a wide range of powers consumed by the lamp Li.

In an embodiment of a circuit arrangement as shown in FIG. 6 suitable for operating a low-pressure mercury discharge lamp with a power rating of 50 W, the resistive impedances have resistance values of 2.2 MΩ, 15.7 kΩ, 100 kΩ, 100 kΩ, and 10 kΩ, respectively. The capacitive impedances C66, C69, and C70 have respective capacitance values of 1 μF, 1 nF and 8.2 nF. A61 and A62 are constructed as operational amplifiers, type LM741, make Philips. A timer, type no. 555, also make Philips, serves as the voltage-controlled monostable multivibrator VCM. A FET, type no. 830, make International Rectifier, forms the switching means S63. The unidirectional means D60 and D65 to D68 are formed by diodes, type BYD37J, make Philips.

Lamp power was varied over a range from 5 to 50 W during operation of the circuit arrangement. The buffer voltage showed only very small variations. The buffer voltage in this case varied in the range between 340 and 350 V. This is higher than the bottom value, i.e. the peak value of the supply voltage in this case, which is 311 V.

We claim:

1. A circuit arrangement for high-frequency operation of a discharge lamp, comprising:

input terminals for connection to a low-frequency supply voltage source, low-frequency rectifying means (LR) for generating a DC voltage across first capacitive means from a low-frequency supply voltage delivered by the low-frequency supply voltage source, a DC/AC converter for generating a high-frequency AC voltage from the DC voltage, a load branch (B) comprising a series arrangement of inductive means, second capacitive means, and coupling means (T3, T4) for coupling the discharge lamp to the load branch, the load branch being coupled to the DC/AC converter, high-frequency rectifying means (HR) for converting the high-frequency voltage generated by the DC/AC converter into a DC voltage, which high-frequency rectifying means is coupled to the first capacitive means and to the load branch and comprises a series arrangement of first and second unidirectional means having the same orientation, control means (CR) for controlling a power consumed by the discharge lamp to a level which is dependent on a control signal (Sg) which is a measure for a desired lamp power, wherein the high-frequency rectifying means in addition comprises further control means (CR1) and a parallel branch including switching means, which parallel branch shunts at least one of the unidirectional means of the high-frequency rectifying means, and said further control means controls the switching means in a manner which is dependent on the control signal.

2. A circuit arrangement as claimed in claim 1, wherein the further control means trigger the switching means periodically alternately into a conducting and a non-conducting state during operation with a duty cycle which is dependent on the control signal.

3. A circuit arrangement as claimed in claim 2, wherein the switching of the switching means into the conducting state takes place while the unidirectional means shunted by the parallel branch is in a conducting state.

4. A circuit arrangement as claimed in claim 3, wherein the switching of the switching means into the non-conducting state takes place while said unidirectional means shunted by the parallel branch is in a non-conducting state.

5. A circuit arrangement as claimed in claim 2 wherein the high-frequency rectifying means is connected to a first junction point in the load branch via a first feedback branch and to a second junction point in the load branch via a further feedback branch.

6. A circuit arrangement as claimed in claim 1, further comprising control signal generation means for generating the control signal, which is adjustable in steps, said control signal generation means being coupled to the further control means.

7. A circuit arrangement as claimed in claim 1, wherein the high-frequency rectifying means is connected to a first junction point in the load branch via a first feedback branch and to a second junction point in the load branch via a further feedback branch, and the coupling means are connected between the first junction point and the second junction point in the load branch.

8. A circuit arrangement as claimed in claim 1, wherein the high-frequency rectifying means comprises two or more feedback units each including first and second unidirectional means, wherein at least one of the unidirectional means of each of the feedback units is shunted by a parallel branch provided with switching means, and the further control means brings the switching means into a stable state which is dependent on the control signal.

9. A circuit arrangement as claimed in claim 8, further comprising control signal generation means for generating the control signal, which is adjustable in steps, said control signal generation means being coupled to the further control means, and each setting of the control signal corresponds to a respective combination of states of the switching means.

10. A circuit arrangement as claimed in claim 1 further comprising first and second feedback units coupled to the load branch and at least one of which includes first and second series coupled unidirectional conduction means, wherein at least one of said first and second unidirectional conduction means is shunted by the switching means.

11. A circuit arrangement as claimed in claimed 10 wherein the high-frequency rectifying means is connected to a first junction point in the load branch via a first feedback branch and to a second junction point in the load branch via a further feedback branch.

12. A circuit arrangement as claimed in claim 1 wherein the switching means is switched into a conducting state at a time when the at least one unidirectional means is in a conducting state.

13. A circuit arrangement as claimed in claim 12 wherein the high-frequency rectifying means is connected to a first junction point in the load branch via a first feedback branch and to a second junction point in the load branch via a further feedback branch.

14. A circuit arrangement as claimed in claim 1 wherein the DC/AC converter comprises at least one switching device, and said control means is responsive to said control signal to alternately and periodically trigger the one switching device on and off so as to generate said high-frequency AC voltage.

15. A circuit arrangement as claimed in claim 1 further comprising first and second series connected feedback units, wherein the first feedback unit includes first and second series coupled unidirectional conduction means and the second feedback unit comprises said second unidirectional conduction means in series with a third unidirectional conduction means, said switching means comprises first and second switching devices connected in parallel with the first and third undirectional conduction means, respectively, and a first feedback branch including a first capacitor coupling the first feedback unit to a first junction point in the load branch and a second feedback branch including a second capacitor coupling the second feedback unit to the first junction point in the load branch, wherein the capacitance of the first capacitor is greater than the capacitance of the second capacitor.

16. A circuit arrangement as claimed in claim 15 further comprising a further feedback unit including fourth and fifth series connected unidirectional conduction means coupled in parallel with the first and second feedback units, and a further feedback branch coupling the further feedback unit to a second junction point in the load branch.

17. A circuit arrangement as claimed in claim 1 wherein the control signal, via the further control means, adjusts the duty cycle of the switching means in a manner so as to maintain the DC voltage across the first capacitive means relatively constant as the lamp power is adjusted in response to the control signal.

* * * * *